US010393060B2

(12) United States Patent
Araki et al.

(10) Patent No.: US 10,393,060 B2
(45) Date of Patent: Aug. 27, 2019

(54) DIVIDING COMPONENT OF COOLING WATER CHANNEL OF WATER JACKET, INTERNAL COMBUSTION ENGINE, AND AUTOMOBILE

(71) Applicant: NICHIAS CORPORATION, Tokyo (JP)

(72) Inventors: Yukari Araki, Toyota (JP); Kentaro Mushiga, Toyota (JP); Yoshihiro Kawasaki, Yokohama (JP); Yoshifumi Fujita, Hamamatsu (JP)

(73) Assignee: NICHIAS CORPORATION, Minato-ku (JP)

( * ) Notice: Subject to any disclaimer, the term of this patent is extended or adjusted under 35 U.S.C. 154(b) by 0 days.

(21) Appl. No.: 15/538,325

(22) PCT Filed: Dec. 21, 2015

(86) PCT No.: PCT/JP2015/085709
§ 371 (c)(1),
(2) Date: Jun. 21, 2017

(87) PCT Pub. No.: WO2016/104444
PCT Pub. Date: Jun. 30, 2016

(65) Prior Publication Data

US 2017/0342939 A1 Nov. 30, 2017

(30) Foreign Application Priority Data

Dec. 22, 2014 (JP) ..... 2014-258314

(51) Int. Cl.
*F02F 1/14* (2006.01)
*F01P 3/02* (2006.01)
*F02F 1/10* (2006.01)

(52) U.S. Cl.
CPC ..... *F02F 1/14* (2013.01); *F01P 3/02* (2013.01); *F01P 2003/021* (2013.01); *F02F 2001/104* (2013.01)

(58) Field of Classification Search
CPC ..... F02F 1/14; F02F 1/10; F02F 1/166; F01P 2003/021
See application file for complete search history.

(56) References Cited

U.S. PATENT DOCUMENTS 8,474,418 B2 * 7/2013 Shikida ..... F01P 3/02 123/41.74
2003/0230253 A1 12/2003 Matsutani et al.
(Continued)

FOREIGN PATENT DOCUMENTS

DE 27 27 124 A1 12/1978
DE 101 02 644 C1 2/2002
(Continued)

OTHER PUBLICATIONS

International Search Report dated Mar. 8, 2016, issued in counterpart International Application No. PCT/JP2015/085709 (2 pages).
(Continued)

*Primary Examiner* — Long T Tran
(74) *Attorney, Agent, or Firm* — Westerman, Hattori, Daniels & Adrian, LLP

(57) ABSTRACT

A water jacket coolant passage division member includes: a partition member that has a planar shape that conforms to a groove-like coolant passage provided to a cylinder block that is provided to an internal combustion engine; an inner-side rubber member that is provided to an inner side of the partition member, and comes in contact with a cylinder bore-side wall surface of the groove-like coolant passage; and an outer-side rubber member that is provided to an outer side of the partition member, and comes in contact with an outer wall surface of the groove-like coolant passage. An
(Continued)

internal combustion engine in which a cylinder bore wall has a uniform temperature can be provided by utilizing the water jacket coolant passage division member.

13 Claims, 14 Drawing Sheets

(56) References Cited

U.S. PATENT DOCUMENTS

| | | | | |
|---|---|---|---|---|
| 2005/0199195 | A1* | 9/2005 | Matsutani | F02F 1/14 123/41.79 |
| 2005/0235930 | A1 | 10/2005 | Xin | |
| 2008/0283001 | A1* | 11/2008 | Konishi | F02F 1/108 123/41.72 |
| 2009/0194046 | A1* | 8/2009 | Shikida | F02F 1/14 123/41.74 |
| 2010/0242868 | A1* | 9/2010 | Shikida | F01P 3/02 123/41.79 |
| 2011/0114043 | A1* | 5/2011 | Hamakawa | F02F 1/14 123/41.74 |
| 2012/0132157 | A1* | 5/2012 | Matsuki | F02F 1/14 123/41.79 |
| 2012/0204821 | A1* | 8/2012 | Tofukuji | F02F 1/14 123/41.79 |
| 2013/0160725 | A1* | 6/2013 | Nishio | F02F 1/10 123/41.79 |
| 2015/0075454 | A1* | 3/2015 | Hamakawa | F02F 1/14 123/41.28 |
| 2015/0159540 | A1* | 6/2015 | Misumi | F02F 1/16 123/41.44 |
| 2015/0267636 | A1* | 9/2015 | Nagai | F01P 3/02 123/41.72 |

FOREIGN PATENT DOCUMENTS

| | | | | |
|---|---|---|---|---|
| JP | 60-6812 | U | | 1/1985 |
| JP | 2-72346 | U | | 6/1990 |
| JP | 2000-345838 | A | | 12/2000 |
| JP | 2002-266695 | A | | 9/2002 |
| JP | 2004-19472 | A | | 1/2004 |
| JP | 2007056771 | A | * | 3/2007 |
| JP | 2008-25474 | A | | 2/2008 |
| JP | 2008-31939 | A | | 2/2008 |
| JP | 2012-202290 | A | | 10/2012 |
| WO | 2008/010584 | A1 | | 1/2008 |

OTHER PUBLICATIONS

Extended (Supplementary) European Search Report dated Jul. 27, 2018, issued in counterpart application No. 15873012.7. (7 pages).

* cited by examiner

DIVIDING COMPONENT OF COOLING WATER CHANNEL OF WATER JACKET, INTERNAL COMBUSTION ENGINE, AND AUTOMOBILE

TECHNICAL FIELD

The present invention relates to a water jacket coolant passage division member that is disposed in a groove-like coolant passage provided to a cylinder block that is provided to an internal combustion engine, and used to control the flow of a coolant that flows through the groove-like coolant passage, an internal combustion engine that includes the water jacket coolant passage division member, and an automobile that includes the internal combustion engine.

BACKGROUND ART

An internal combustion engine is designed so that fuel explodes within the cylinder bore when the piston is positioned at top dead center, and the piston is moved downward due to the explosion. Therefore, the upper part of the cylinder bore wall increases in temperature as compared with the lower part of the cylinder bore wall. Accordingly, a difference in the amount of thermal deformation occurs between the upper part and the lower part of the cylinder bore wall (i.e., the upper part of the cylinder bore wall expands to a large extent as compared with the lower part of the cylinder bore wall).

As a result, the frictional resistance of the piston against the cylinder bore wall increases, and the fuel consumption increases. Therefore, a reduction in difference in the amount of thermal deformation between the upper part and the lower part of the cylinder bore wall has been desired.

Attempts have been made to control the cooling efficiency in the upper part and the lower part of the cylinder bore wall due to the coolant by disposing a water jacket spacer in a groove-like coolant passage to adjust the flow of the coolant in the groove-like coolant passage such that the cylinder bore wall has a uniform temperature. For example, Patent Literature 1 discloses an internal combustion engine heating medium passage partition member that is disposed in a groove-like heating medium passage formed in a cylinder block of an internal combustion engine to divide the groove-like heating medium passage into a plurality of passages, the heating medium passage partition member including a passage division member that is formed at a height above the bottom of the groove-like heating medium passage, and serves as a wall that divides the groove-like heating medium passage into a bore-side passage and a non-bore-side passage, and a flexible lip member that is formed from the passage division member in the opening direction of the groove-like heating medium passage, the edge area of the flexible lip member being formed of a flexible material to extend beyond the inner surface of one of the groove-like heating medium passages, and coming in contact with the inner surface at a middle position of the groove-like heating medium passage in the depth direction due to the flexure restoring force after insertion into the groove-like heating medium passage to separate the bore-side passage and the non-bore-side passage.

CITATION LIST

Patent Literature

Patent Literature 1: JP-A-2008-31939 (claims)

SUMMARY OF INVENTION

Technical Problem

According to the internal combustion engine heating medium passage partition member disclosed in Patent Literature 1, since the temperature of the cylinder bore wall can be made uniform to a certain extent, the difference in the amount of thermal deformation between the upper area and the lower area of the cylinder bore wall can be reduced. However, a further reduction in the difference in the amount of thermal deformation between the upper part and the lower part of the cylinder bore wall has been desired.

An object of the invention is to provide a means that ensures that the cylinder bore wall has a uniform temperature, an internal combustion engine that includes the means, and an automobile that includes the internal combustion engine.

Solution to Problem

The inventors conducted extensive studies in order to solve the above problem, and found that, when a coolant passage division member in which rubber members are provided to the inner side and the outer side of a partition member having a shape conforming to the groove-like coolant passage, is disposed in the water jacket to divide the groove-like coolant passage into an upper part and a lower part, it is possible to separately control the flow rate of the coolant that flows through the upper passage of the groove-like coolant passage, and the flow rate of the coolant that flows through the lower passage of the groove-like coolant passage, and separately adjust the degree of cooling with respect to the upper part and the lower part of the cylinder bore wall. This finding has led to the completion of the invention.

(1) According to one aspect of the invention, a water jacket coolant passage division member includes:

a partition member that divides a groove-like coolant passage into an upper part and a lower part, the groove-like coolant passage being provided to a cylinder block that is provided to an internal combustion engine;

an inner-side rubber member that is provided to the inner side of the partition member, and comes in contact with the cylinder bore-side wall surface of the groove-like coolant passage; and an outer-side rubber member that is provided to the outer side of the partition member, and comes in contact with the outer wall surface of the groove-like coolant passage.

(2) According to another aspect of the invention, an internal combustion engine includes the water jacket spacer according to (1) that is disposed in a groove-like coolant passage provided to a cylinder block.

(3) According to a further aspect of the invention, an automobile includes the internal combustion engine according to (2).

Advantageous Effects of Invention

The aspects of the invention thus provide a means that ensures that the cylinder bore wall has a uniform temperature, an internal combustion engine that includes the means, and an automobile that includes the internal combustion engine.

DESCRIPTION OF EMBODIMENTS

A water jacket coolant passage division member according to one aspect of the invention includes a partition member that divides a groove-like coolant passage into an upper part and a lower part, the groove-like coolant passage being provided to a cylinder block that is provided to an internal combustion engine, an inner-side rubber member that is provided to the inner side of the partition member, and comes in contact with the cylinder bore-side wall surface of the groove-like coolant passage, and an outer-side rubber member that is provided to the outer side of the partition member, and comes in contact with the outer wall surface of the groove-like coolant passage.

The water jacket coolant passage division member according to one aspect of the invention may be designed so that the partition member has a shape that conforms to the entirety of the groove-like coolant passage, the inner-side rubber member is provided to the entirety or part of the inner side of the partition member along the longitudinal direction, and the outer-side rubber member is provided to the entirety or part of the outer side of the partition member along the longitudinal direction.

The water jacket coolant passage division member according to one aspect of the invention may be designed so that the partition member has a shape that conforms to part of the groove-like coolant passage, the inner-side rubber member is provided to the entirety or part of the inner side of the partition member along the longitudinal direction, and the outer-side rubber member is provided to the entirety or part of the outer side of the partition member along the longitudinal direction.

Figure 1:
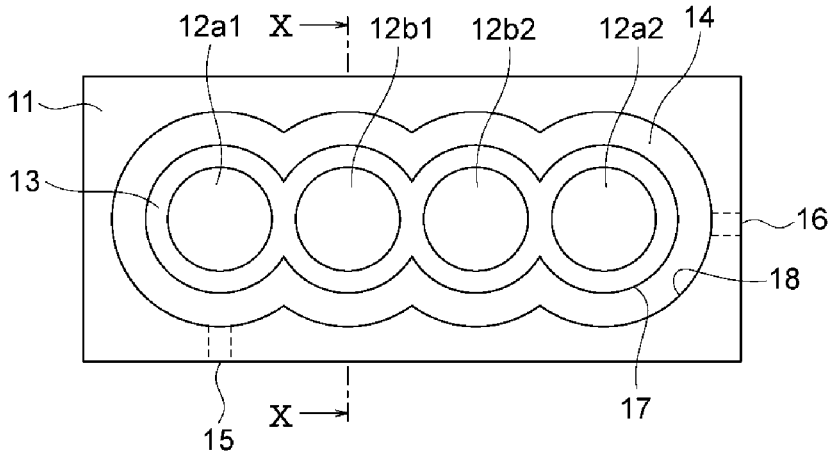
FIG. 1 is a schematic plan view illustrating an example of a cylinder block in which a water jacket spacer according to one aspect of the invention is disposed.
Figure 2:
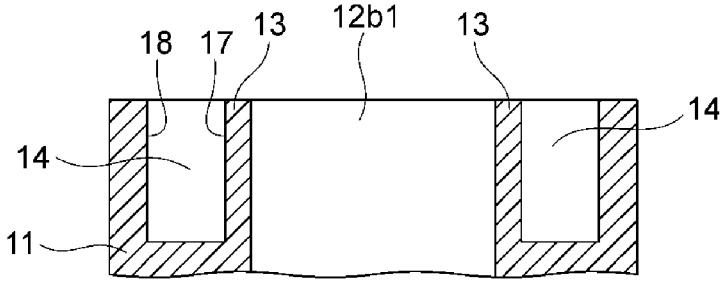
FIG. 2 is an end view taken along the line x-x illustrated in FIG. 1.
Figure 3:
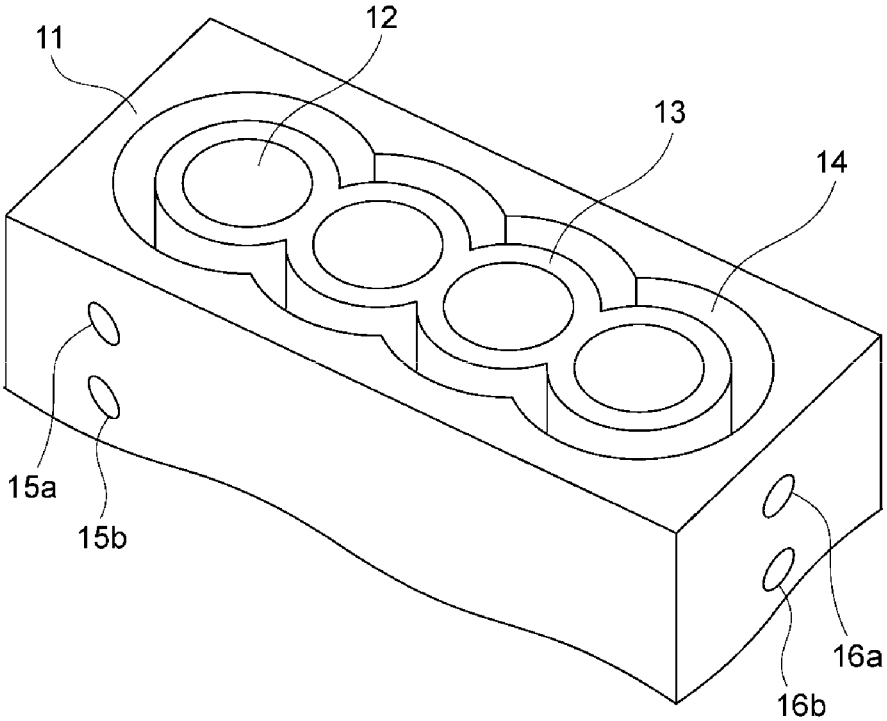
FIG. 3 is a perspective view illustrating the cylinder block illustrated in FIG. 1.
Figure 4:
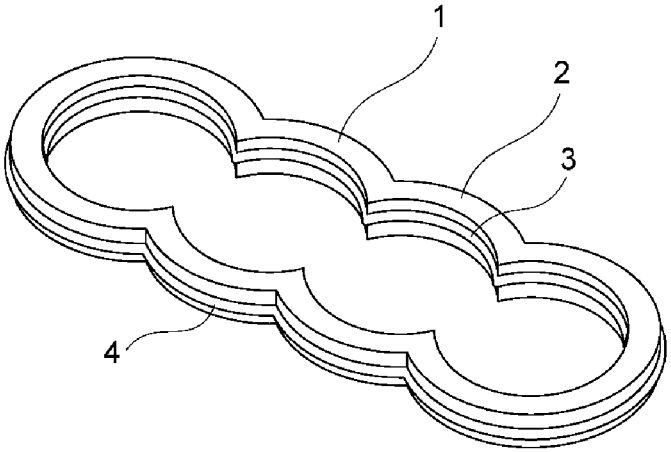
FIG. 4 is a schematic perspective view illustrating an example of a water jacket coolant passage division member (first embodiment).
Figure 5:
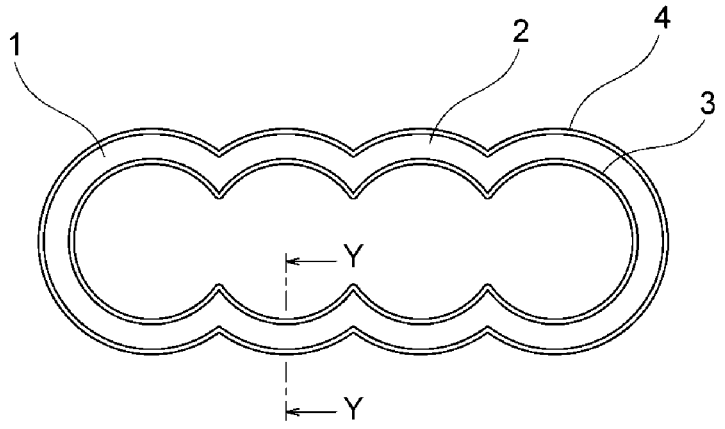
FIG. 5 is a top view illustrating the water jacket coolant passage division member illustrated in FIG. 4.
Figure 6:
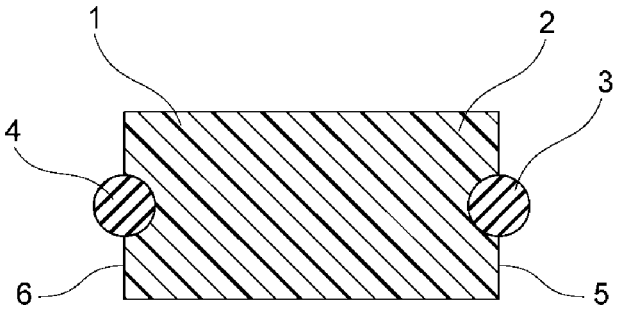
FIG. 6 is an end view taken along the line y-y illustrated in FIG. 5.
Figure 7:
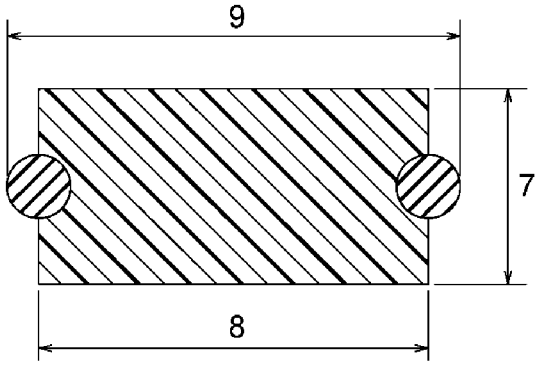
FIG. 7 is an end view taken along the line y-y illustrated in FIG. 5.
Figure 8:
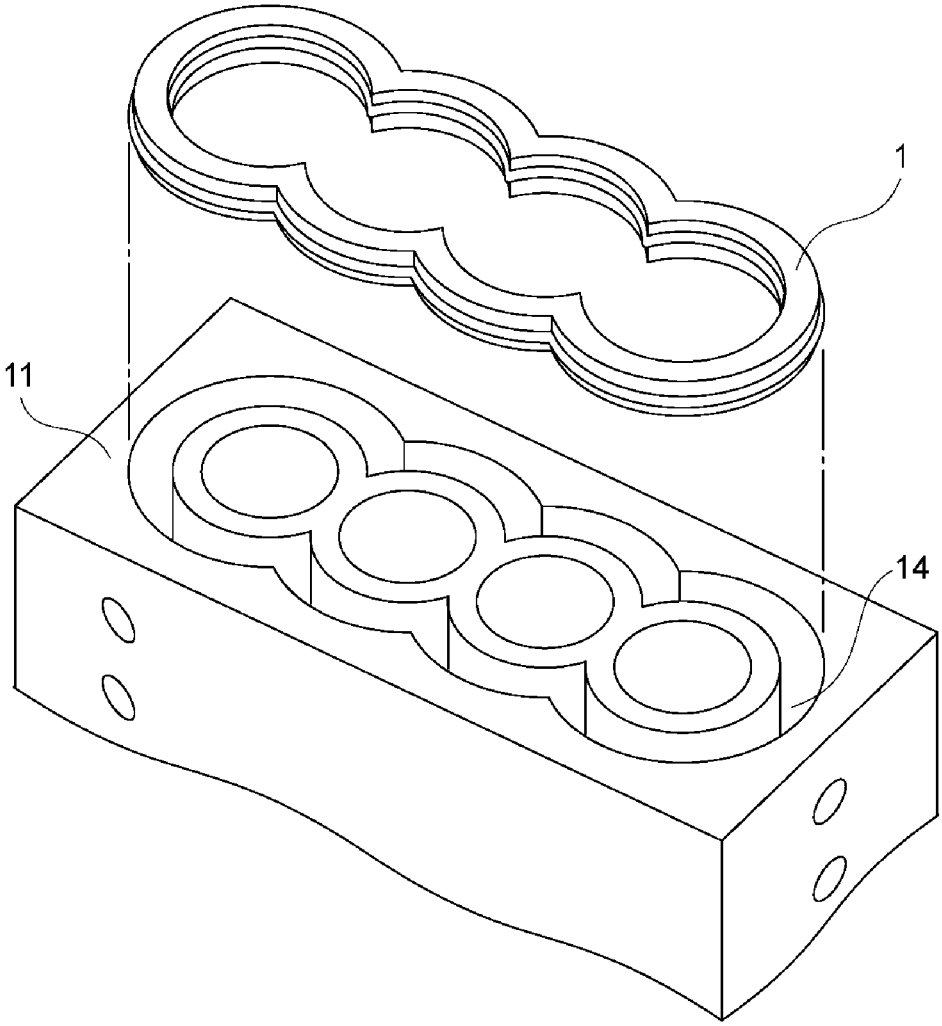
FIG. 8 is a schematic view illustrating a state in which the water jacket coolant passage division member illustrated in FIG. 4 is disposed in the cylinder block illustrated in FIG. 2.
Figure 9:
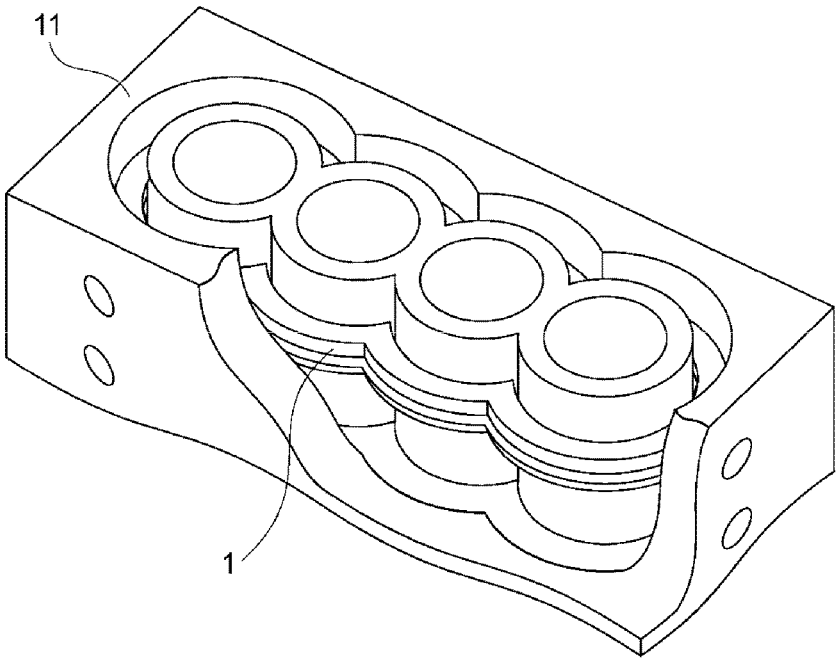
FIG. 9 is a schematic view illustrating a state in which the water jacket coolant passage division member illustrated in FIG. 4 is disposed in a groove-like coolant passage provided to the cylinder block illustrated in FIG. 2.
Figure 10:
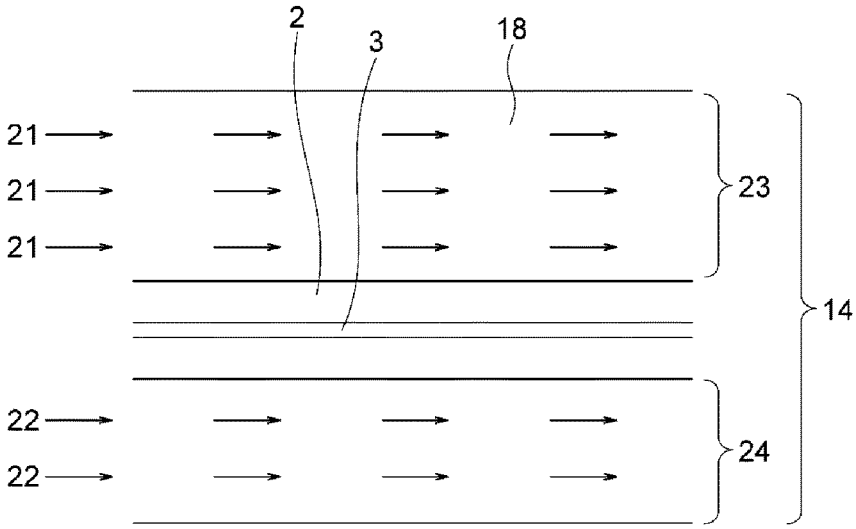
FIG. 10 is a view illustrating a groove-like coolant passage from a cylinder bore-side wall surface in a state in which a water jacket coolant passage division member (first embodiment) is disposed in the groove-like coolant passage.
Figure 11:
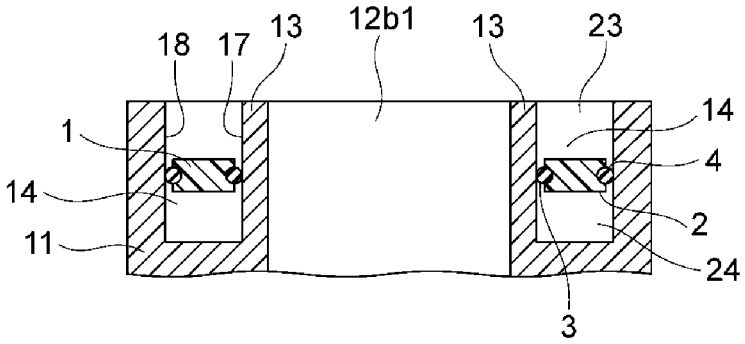
FIG. 11 is an end view illustrating a state in which a water jacket coolant passage division member (first embodiment) is disposed in a groove-like coolant passage.

The water jacket coolant passage division member according to one aspect of the invention may be designed so that the partition member is formed of a resin. A water jacket coolant passage division member according to a first embodiment of the invention is designed so that the partition member is formed of a resin (resin partition member). An example of the water jacket coolant passage division member according to the first embodiment of the invention, and an example of an internal combustion engine provided with the water jacket coolant passage division member according to the first embodiment of the invention, are described below with reference to FIGS. 1 to 11. FIGS. 1 to 3 illustrate an example of a cylinder block in which the water jacket coolant passage division member according to one aspect of the invention is disposed. FIG. 1 is a schematic plan view illustrating the cylinder block in which the water jacket coolant passage division member according to one aspect of the invention is disposed, FIG. 2 is an end view taken along the line x-x illustrated in FIG. 1, and FIG. 3 is a perspective view illustrating the cylinder block illustrated in FIG. 1. FIGS. 4 to 7 illustrate an example of the water jacket coolant passage division member according to the first embodiment of the invention. FIG. 4 is a schematic perspective view illustrating an example of the water jacket coolant passage division member according to the first embodiment of the invention, FIG. 5 is a top view illustrating the water jacket coolant passage division member illustrated in FIG. 4, and FIGS. 6 and 7 are end views taken along the line y-y illustrated in FIG. 4. FIG. 8 is a schematic view illustrating a state in which the water jacket coolant passage division member illustrated in FIG. 4 is disposed the cylinder block illustrated in FIG. 2, FIG. 9 is a schematic view illustrating a state in which the water jacket coolant passage division member illustrated in FIG. 4 is disposed in a groove-like coolant passage provided to the cylinder block illustrated in FIG. 2, FIG. 10 is a view illustrating the groove-like coolant passage from a cylinder bore-side wall surface in a state in which the water jacket coolant passage division member is disposed in the groove-like coolant passage, and FIG. 11 is an end view illustrating a state in which the water jacket coolant passage division member is disposed in the groove-like coolant passage.

As illustrated in FIGS. 1 to 3, an open-deck cylinder block 11 for an automotive internal combustion engine (in which the water jacket coolant passage division member is disposed) includes a plurality of bores 12 and a groove-like coolant passage 14, a piston moving upward and downward in each bore 12, and a coolant flowing through the groove-like coolant passage 14. The boundary between the bores 12 and the groove-like coolant passage 14 is defined by a cylinder bore wall 13. The cylinder block 11 also includes coolant inlets 15*a* and 15*b* for supplying the coolant to the groove-like coolant passage 14, and coolant outlets 16*a* and 16*b* for discharging the coolant from the groove-like coolant passage 11. The coolant inlet 15*a* is an inlet for supplying the coolant to the upper passage of the groove-like coolant passage 14, the coolant inlet 15*b* is an inlet for supplying the coolant to the lower passage of the groove-like coolant passage 14, the coolant outlet 16*a* is an outlet for discharging the coolant from the upper passage of the groove-like coolant passage 14, and the coolant outlet 16*b* is an outlet for discharging the coolant from the lower passage of the groove-like coolant passage 14.

The cylinder block 11 includes two or more bores 12 that are formed (arranged) in series. Specifically, the bores 12 include end bores 12*a*1 and 12*a*2 that are formed to be adjacent to one bore, and intermediate bores 12*b*1 and 12*b*2 that are formed between two bores. Note that only the end bores are provided when the number of bores formed in the cylinder block is 2. The end bores 12*a*1 and 12*a*2 among the bores 12 that are arranged in series are bores situated on either end, and the intermediate bores 12*b*1 and 12*b*2 among the bores 12 that are arranged in series are bores situated between the end bore 12*a*1 situated on one end and the end bore 12*a*2 situated on the other end.

The wall surface of the groove-like coolant passage 14 that is situated on the side of the cylinder bores is referred to as "cylinder bore-side wall surface 17", and the wall surface of the groove-like coolant passage 14 that is situated opposite to the cylinder bore-side wall surface 17 is referred to as "outer wall surface 18".

A water jacket coolant passage division member 1 illustrated in FIGS. 4 to 7 includes a resin partition member 2, an inner-side rubber member 3, and an outer-side rubber member 4.

The resin partition member 2 is a member that is formed of a resin, and is produced by forming a resin so as to have the desired shape. The resin partition member 2 functions as a partition member that divides the groove-like coolant passage 14 into an upper part and a lower part.

The inner-side rubber member 3 is provided to an inner side surface 5 of the resin partition member. The inner-side rubber member 3 is provided to the inner side surface 5 of the resin partition member by fitting the inner-side rubber member 3 into a receiving section that is formed in the inner side surface 5 of the resin partition member. Note that the inner side surface 5 of the resin partition member is situated opposite to the cylinder bore-side wall surface 17 of the groove-like coolant passage 14 when the water jacket coolant passage division member 1 has been disposed in the groove-like coolant passage 14.

The outer-side rubber member 4 is provided to an outer side surface 6 of the resin partition member. The outer-side rubber member 4 is provided to the outer side surface 6 of the resin partition member by fitting the outer-side rubber member 4 into a receiving section that is formed in the outer side surface 6 of the resin partition member. Note that the outer side surface 6 of the resin partition member is situated opposite to the outer wall surface 18 of the groove-like coolant passage 14 when the water jacket coolant passage division member 1 has been disposed in the groove-like coolant passage 14.

As illustrated in FIG. 8, the water jacket coolant passage division member 1 is inserted into the groove-like coolant passage 14 provided to the cylinder block 11, and disposed in the groove-like coolant passage 14 (see FIGS. 9 to 11). Note that FIG. 10 illustrates only the resin partition member, and the outer wall surface of the groove-like coolant passage.

When the water jacket coolant passage division member 1 is disposed in the groove-like coolant passage 14, the inner-side rubber member 3 comes in contact with the cylinder bore-side wall surface 17 of the groove-like coolant passage 14, and the outer-side rubber member 4 comes in contact with the outer wall surface 18 of the groove-like coolant passage 14.

When the inner-side rubber member 3 has come in contact with the cylinder bore-side wall surface 17 of the groove-like coolant passage 14, and the outer-side rubber member 4 has come in contact with the outer wall surface 18 of the groove-like coolant passage 14, so that the resin partition member 2 has been secured within the groove-like coolant passage 14, the groove-like coolant passage 14 is divided by the water jacket coolant passage division member 1 into an upper passage 23 and a lower passage 24. Therefore, when a pump that supplies a coolant 21 to the upper passage 23 of the groove-like coolant passage, and a pump that supplies a coolant 22 to the lower passage 24 of the groove-like coolant passage, are separately provided, it is possible to cause the flow rate of the coolant to differ between the upper passage 23 and the lower passage 24 of the groove-like coolant passage, and separately adjust the flow rate of the coolant that flows through the upper passage 23 of the groove-like coolant passage, and the flow rate of the coolant that flows through the lower passage 24 of the groove-like coolant passage.

Specifically, the water jacket coolant passage division member according to the first embodiment of the invention includes a resin partition member that divides a groove-like coolant passage into an upper part and a lower part, the groove-like coolant passage being provided to a cylinder block that is provided to an internal combustion engine, an inner-side rubber member that is provided to the inner side surface of the resin partition member, and comes in contact with the cylinder bore-side wall surface of the groove-like coolant passage, and an outer-side rubber member that is provided to the outer side surface of the resin partition member, and comes in contact with the outer wall surface of the groove-like coolant passage.

The water jacket coolant passage division member according to the first embodiment of the invention may be designed so that the resin partition member has a shape that conforms to the entirety of the groove-like coolant passage, the inner-side rubber member is provided to the entirety or part of the inner side surface of the resin partition member along the longitudinal direction, and the outer-side rubber member is provided to the entirety or part of the outer side surface of the resin partition member along the longitudinal direction.

A water jacket coolant passage division member according to a second embodiment of the invention may be designed so that the resin partition member has a shape that conforms to part of the groove-like coolant passage, the inner-side rubber member is provided to the entirety or part of the inner side surface of the resin partition member along the longitudinal direction, and the outer-side rubber member is provided to the entirety or part of the outer side surface of the resin partition member along the longitudinal direction.

The resin partition member is a member that divides the groove-like coolant passage into an upper part and a lower part, and is produced by forming a resin so as to have the desired shape. The resin partition member functions as a partition member that divides the groove-like coolant passage into an upper part and a lower part along the circumferential direction when the water jacket coolant passage division member has been disposed in the groove-like coolant passage. Therefore, the resin partition member has a shape that conforms to the shape of the groove-like coolant passage when viewed from above. Specifically, the resin partition member has a shape that can divide the groove-like coolant passage into an upper part and a lower part together with the inner-side rubber member and the outer-side rubber member at a position (position in the upward-downward direction) at which the resin partition member is disposed.

Examples of a material for producing the resin partition member include a thermoplastic resin, a thermosetting resin, and the like. It is preferable to use a material that exhibits excellent long-life coolant resistance (hereinafter referred to as "LLC resistance"), excellent strength, and excellent formability. Examples of the thermoplastic resin that may be used to produce the resin partition member include polyethylene, polytetrafluoroethylene, polypropylene, polystyrene, acrylonitrile, butadiene, a styrene resin, polyvinyl chloride, acrylonitrile, a styrene resin, a methacrylic resin, vinyl chloride, a polyamide, polyacetal, a polycarbonate, a modified polyphenylene ether, polybutylene terephthalate, a GF-reinforced polyethylene terephthalate, an ultrahigh-molecular-weight polyethylene, polyphenylene sulfide, a polyimide, polyetherimide, polyarylate, a polysulfone, a polyethersulfone, polyether ether ketone, a liquid crystal polymer, and the like. Examples of the thermosetting resin that may be used to produce the resin partition member include a polyester (e.g., polyethylene terephthalate, polybutylene terephthalate, polytrimethylene terephthalate, polyethylene naphthalate, and liquid crystal polyester), a polyolefin (e.g., polyethylene, polypropylene, and polybutylene), polyoxymethylene, a polyamide, polyphenylene sulfide, polyketone, polyetherketone, polyether ether ketone, polyetherketoneketone, polyether nitrile, a fluorine-based resin (e.g., polytetrafluoroethylene), a crystalline resin (e.g., liquid crystal polymer), a styrene-based resin, an amorphous resin (e.g., polycarbonate, poly(methyl methacrylate), polyvinyl chloride, polyphenylene ether, polyimide, polyamide-imide, polyetherimide, polysulfone, polyether sulphone, and polyarylate), a phenol-based resin, a phenoxy resin, a thermoplastic elastomer (e.g., polystyrene-based thermoplastic elastomer, polyolefin-based thermoplastic elastomer, polyurethane-based thermoplastic elastomer, polyester-based thermoplastic elastomer, polyamide-based thermoplastic elastomer, polybutadiene-based thermoplastic elastomer, polyisoprene-based thermoplastic elastomer, fluorine-based thermoplastic elastomer, and acrylonitrile-based thermoplastic elastomer), a copolymer and a modified product thereof, and the like. It is preferable to use a GF-reinforced polyethylene terephthalate as the material for producing the resin partition member.

The thickness of the resin partition member is not particularly limited, but is preferably 2 to 30 mm, and particularly preferably 5 to 20 mm. The volume of the partition member increases, and the capacity of the water jacket decreases, as the thickness of the resin partition member increases. If the thickness of the resin partition member is too large, the capacity of the water jacket may decrease to a large extent, and the pressure loss when the coolant flows may increase, whereby the flow rate of the coolant may become insufficient, or the load applied to the water pump may increase. Therefore, the thickness of the resin partition member is preferably set to 30 mm or less, and particularly preferably 20 mm or less. If the thickness of the resin partition member is too small, the resin partition member may break due to the flow of the coolant. Therefore, the thickness of the resin partition member is preferably set to 2 mm or more, and particularly preferably 5 mm or more. The width of the resin partition member is appropriately selected taking account of the width of the groove-like coolant passage. Note that the thickness of the resin partition member refers to the length indicated by reference numeral 7 in FIG. 7, and the width of the resin partition member refers to the length indicated by reference numeral 8 in FIG. 7.

Figure 12:
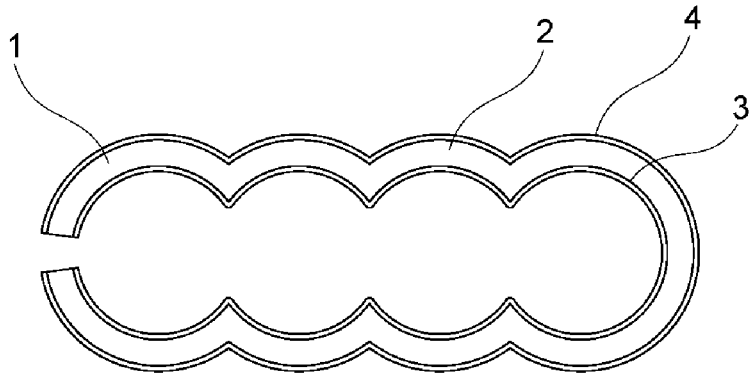
FIG. 12 is a plan view illustrating an example of a water jacket coolant passage division member (first embodiment).
Figure 13A:
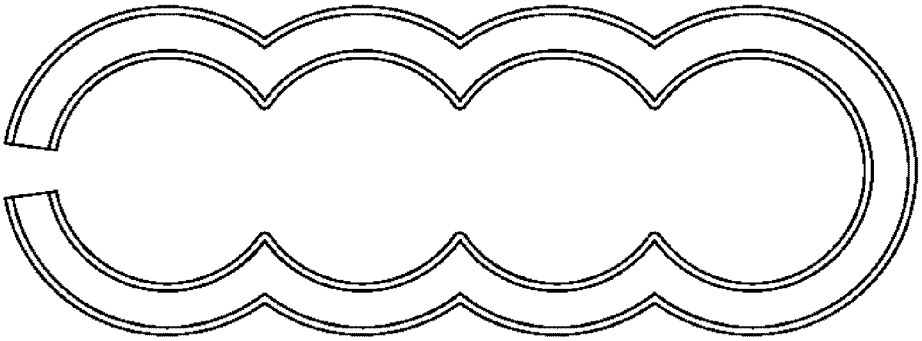
FIGS. 13A through 13C each is a schematic perspective view illustrating another example of a water jacket coolant passage division member (first embodiment).
Figure 13B:
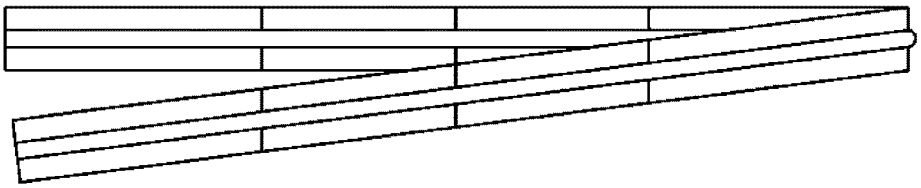
Figure 13C:
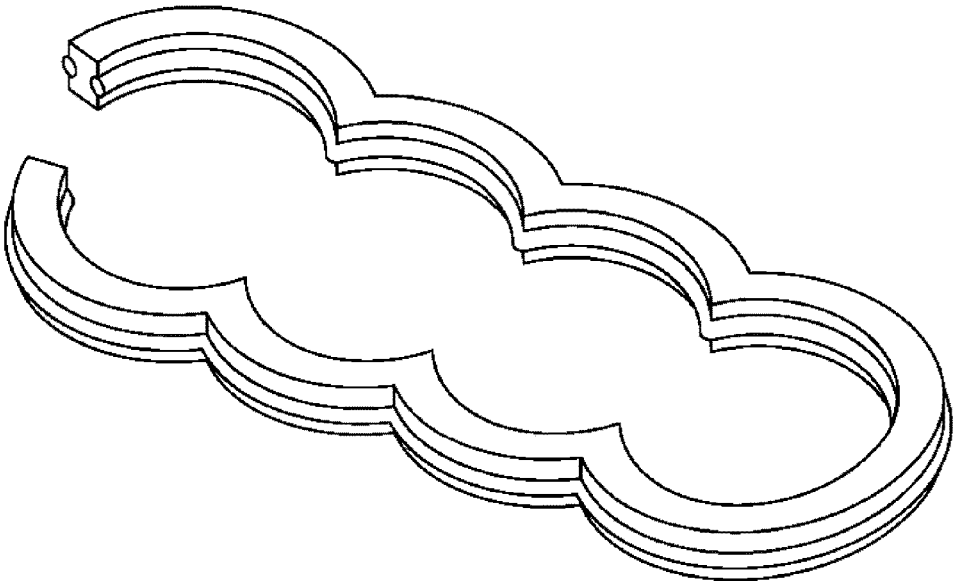
Figure 14:
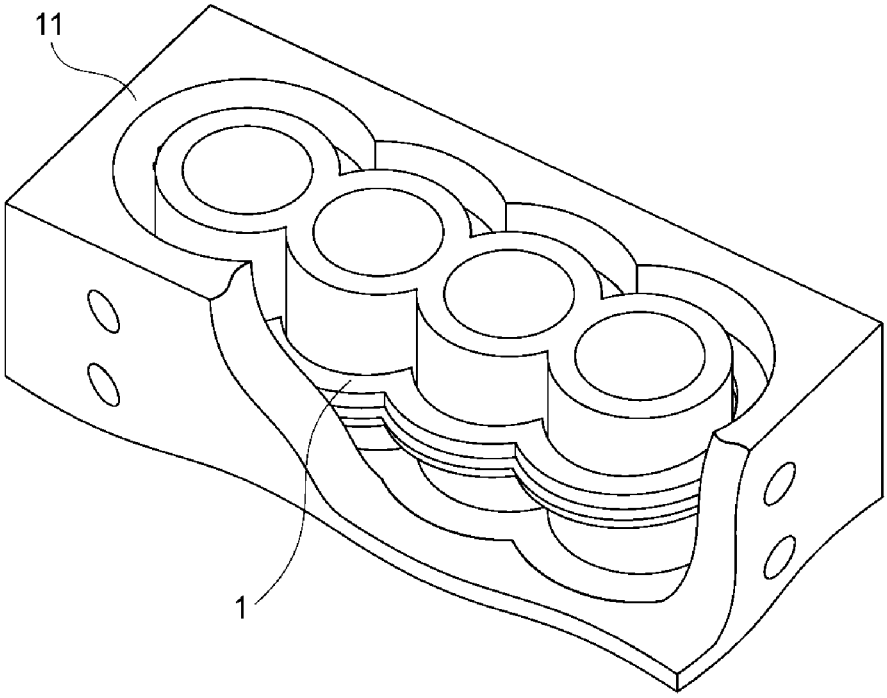
FIG. 14 is a schematic perspective view illustrating another example of a water jacket coolant passage division member (first embodiment).

In the example illustrated in FIG. 4, the resin partition member is continuously disposed in the groove-like coolant passage along the longitudinal direction. Note that the shape of the resin partition member is not particularly limited as long as it is possible to separately adjust the flow rate of the coolant that flows through the upper passage of the groove-like coolant passage, and the flow rate of the coolant that flows through the lower passage of the groove-like coolant passage. For example, the resin partition member may be broken along the longitudinal direction (see FIG. 12) as long as it is possible to substantially separately adjust the flow rate of the coolant that flows through the upper passage of the groove-like coolant passage, and the flow rate of the coolant that flows through the lower passage of the groove-like coolant passage. Specifically, the resin partition member may have a shape that conforms to the entirety of the groove-like coolant passage, or may have a shape that conforms to part of the groove-like coolant passage. Note that FIG. 12 is a schematic view illustrating an example of the resin partition member (i.e., a top view illustrating the resin partition member). Note that the longitudinal direction of the groove-like coolant passage and the longitudinal direction of the partition member refer to the circumferential direction along the cylinder bore wall.

In the example illustrated in FIG. 4, the resin partition member is formed so that the position of the resin partition member within the groove-like coolant passage in the upward-downward direction is almost constant along the circumferential direction of the groove-like coolant passage. Note that the resin partition member may be formed so that the position of the resin partition member within the groove-like coolant passage in the upward-downward direction differs depending on the position along the circumferential direction of the groove-like coolant passage (see FIGS. 13A to 13C and FIG. 14). Specifically, the resin partition member may be formed so that the position at which the groove-like coolant passage is divided by the partition member in the upward-downward direction is constant along the circumferential direction of the groove-like coolant passage, or may be formed so that the position at which the groove-like coolant passage is divided by the partition member in the upward-downward direction differs depending on the position along the circumferential direction of the groove-like coolant passage.

The inner-side rubber member and the outer-side rubber member are respectively provided to the inner side surface and the outer side surface of the resin partition member so that the inner-side rubber member and the outer-side rubber member come in contact with the wall surface of the groove-like coolant passage when the water jacket coolant passage division member has been disposed in the groove-like coolant passage such that the resin partition member is secured in the upward-downward direction.

When the water jacket coolant passage division member has been disposed in the groove-like coolant passage, the inner-side rubber member has come in contact with the cylinder bore-side wall surface of the groove-like coolant passage, and the outer-side rubber member has come in contact with the outer wall surface of the groove-like coolant passage (i.e., when the resin partition member has been fixed at a specific position), the groove-like coolant passage is divided into the upper passage and the lower passage.

In the example illustrated in FIG. 4, both the inner-side rubber member and the outer-side rubber member are continuously provided along the longitudinal direction of the resin partition member. Note that the configuration is not limited thereto. For example, the inner-side rubber member or the outer-side rubber member may be broken as long as it is possible to substantially separately adjust the flow rate of the coolant that flows through the upper passage of the groove-like coolant passage, and the flow rate of the coolant that flows through the lower passage of the groove-like coolant passage. Specifically, the inner-side rubber member may be provided to the entirety of the inner side surface of the resin partition member along the longitudinal direction, or may be provided to part of the inner side surface of the resin partition member along the longitudinal direction. The outer-side rubber member may be provided to the entirety of the outer side surface of the resin partition member along the longitudinal direction, or may be provided to part of the outer side surface of the resin partition member along the longitudinal direction.

A material for producing the inner-side rubber member and the outer-side rubber member is not particularly limited as long as the inner-side rubber member and the outer-side rubber member can come in contact with the cylinder bore-side wall surface or the outer wall surface of the groove-like coolant passage to substantially divide the groove-like coolant passage into the upper passage and the lower passage, and the material exhibits excellent LLC resistance, and exhibits a heat resistance sufficient to endure the temperature of the cylinder bore-side wall surface within the groove-like coolant passage. It is preferable that the inner-side rubber member and the outer-side rubber member be formed of a rubber material having a rubber hardness of 5 to 50, and particularly preferably 10 to 30. Examples of the material for producing the inner-side rubber member and the outer-side rubber member include a silicone rubber, a fluororubber, a natural rubber, a butadiene rubber, an ethylene-propylene-diene rubber (EPDM), a nitrile-butadiene rubber (NBR), and the like. It is preferable to use a heat-expandable rubber such as a silicone rubber, a fluororubber, a natural rubber, a butadiene rubber, an ethylene-propylene-diene rubber (EPDM), or a nitrile-butadiene rubber (NBR). The term "heat-expandable rubber" used herein refers to a composite obtained by impregnating a base foam material with a thermoplastic substance having a melting point lower than that of the base foam material, and compressing the resulting product. The heat-expandable rubber is characterized in that the compressed state is maintained at room temperature by the cured product of the thermoplastic substance that is present at least in the surface area, and the cured product of the thermoplastic substance softens due to heating so that the compressed state is canceled. When the inner-side rubber member and the outer-side rubber member are formed of the heat-expandable rubber, the heat-expandable rubber expands (is deformed) to have a specific shape when the water jacket spacer according to one embodiment of the invention has been disposed in the groove-like coolant passage, and heat has been applied to the heat-expandable rubber. Examples of the base foam material used to produce the heat-expandable rubber include a silicone rubber, a fluororubber, a natural rubber, a butadiene rubber, an ethylene-propylene-diene rubber (EPDM), and a nitrile-butadiene rubber (NBR). It is preferable to use a thermoplastic substance having a glass transition temperature, a melting point, or a softening temperature of less than 120° C. as the thermoplastic substance used to produce the heat-expandable rubber. Examples of the thermoplastic substance used to produce the heat-expandable rubber include a thermoplastic resin such as polyethylene, polypropylene, polystyrene, polyvinyl chloride, polyvinylidene chloride, polyvinyl acetate, a polyacrylate, a styrene-butadiene copolymer, chlorinated polyethylene, polyvinylidene fluoride, an ethylene-vinyl acetate copolymer, an ethylene-vinyl acetate-vinyl chloride-acrylate copolymer, an ethylene-vinyl acetate-acrylate copolymer, an ethylene-vinyl acetate-vinyl chloride copolymer, nylon, an acrylonitrile-butadiene copolymer, polyacrylonitrile, polyvinyl chloride, polychloroprene, polybutadiene, a thermoplastic polyimide, a polyacetal, polyphenylene sulfide, a polycarbonate, and a thermoplastic polyurethane, and a thermoplastic compound such as a low-melting-point glass frit, starch, a solder, and a wax.

The length (i.e., the length indicated by reference numeral 9 in FIG. 6) from the contact part of the inner-side rubber member to the contact part of the outer-side rubber member is appropriately selected corresponding to the groove-like coolant passage.

In the example illustrated in FIG. 4, the inner-side rubber member and the outer-side rubber member are provided to the inner side and the outer side of the resin partition member in a state in which the inner-side rubber member and the outer-side rubber member are fitted into the receiving sections formed in the inner wall surface and the outer wall surface of the resin partition member. Note that the configuration is not limited thereto. An arbitrary method may be used as long as the inner-side rubber member and the outer-side rubber member can be provided to the inner side and the outer side of the resin partition member. For example, the inner-side rubber member and the outer-side rubber member may be provided to the inner side surface and the outer side surface of the resin partition member by means of injection molding.

Figure 15:
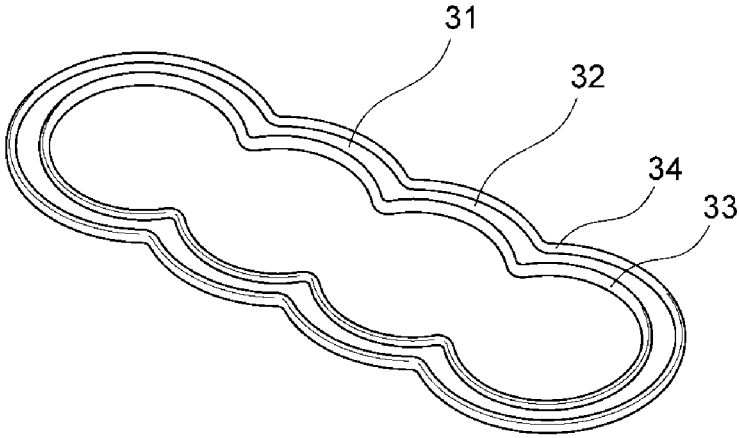
FIG. 15 is a schematic perspective view illustrating an example of a water jacket coolant passage division member (second embodiment).
Figure 16:
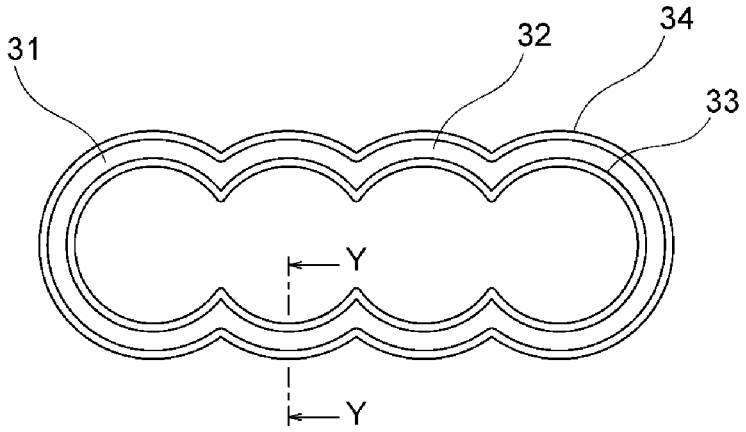
FIG. 16 is a top view illustrating the water jacket coolant passage division member illustrated in FIG. 15.
Figure 17:
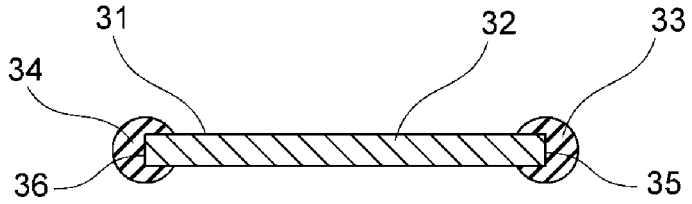
FIG. 17 is an end view taken along the line y-y illustrated in FIG. 16.
Figure 18:
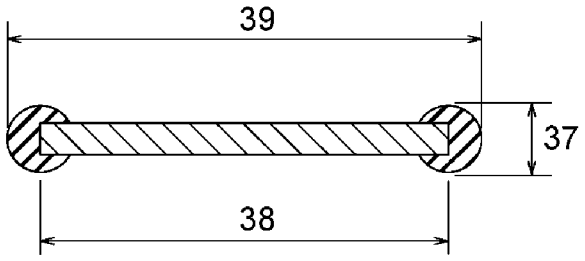
FIG. 18 is an end view taken along the line y-y illustrated in FIG. 16.
Figure 19:
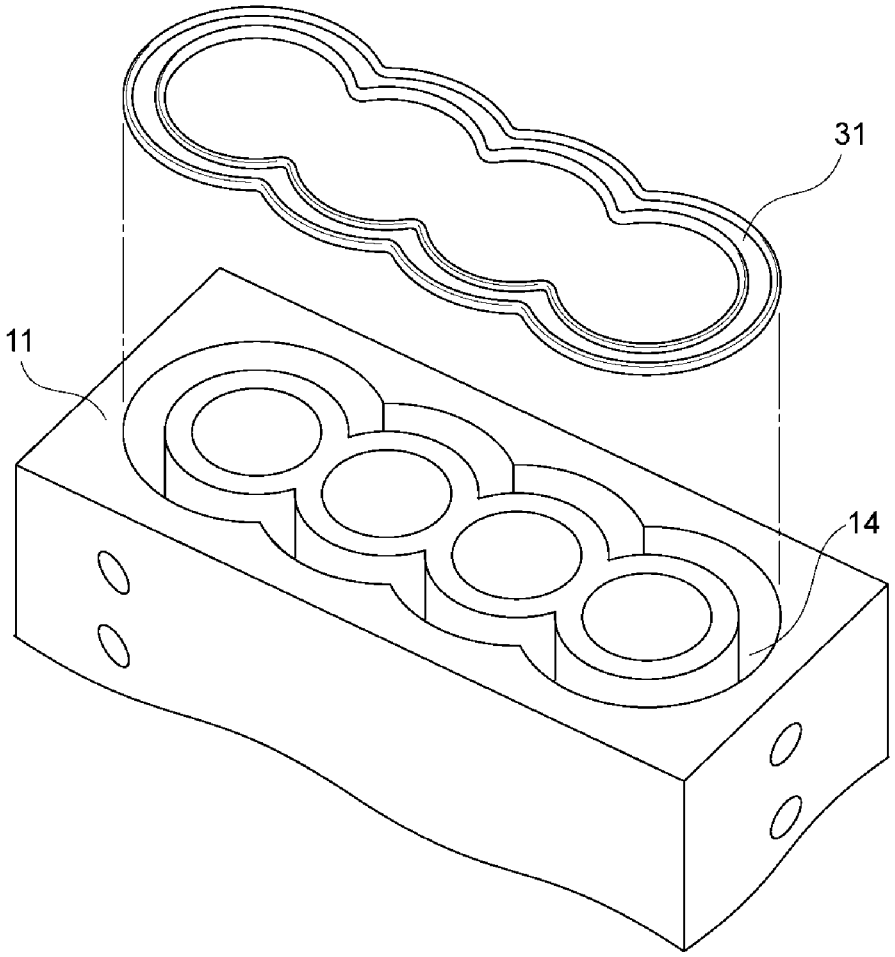
FIG. 19 is a schematic view illustrating a state in which the water jacket coolant passage division member illustrated in FIG. 15 is disposed in the cylinder block illustrated in FIG. 2.
Figure 20:
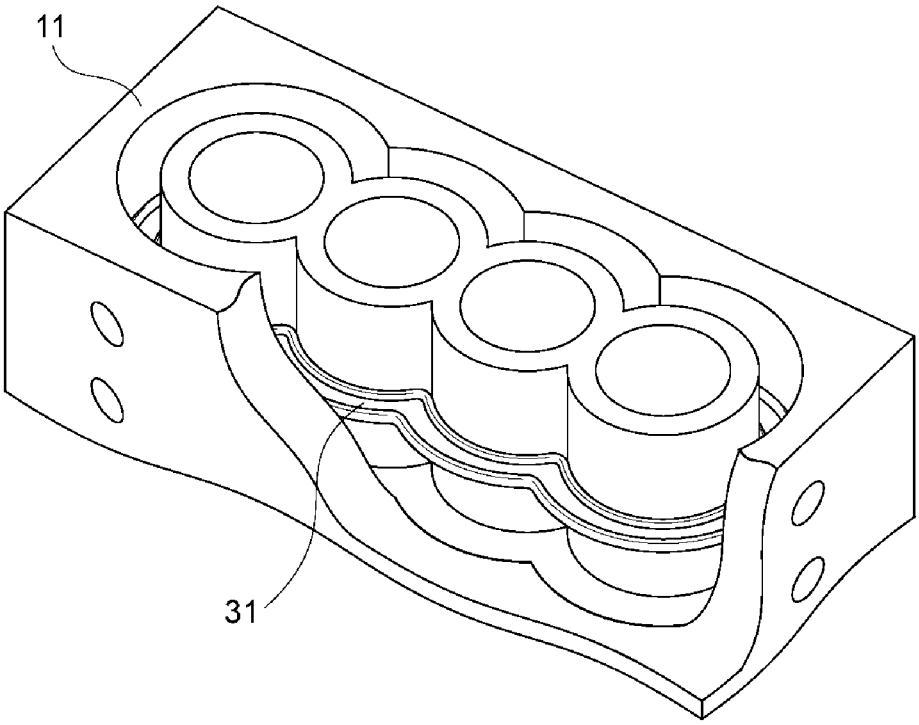
FIG. 20 is a schematic view illustrating a state in which the water jacket coolant passage division member illustrated in FIG. 15 is disposed in a groove-like coolant passage provided to the cylinder block illustrated in FIG. 2.
Figure 21:
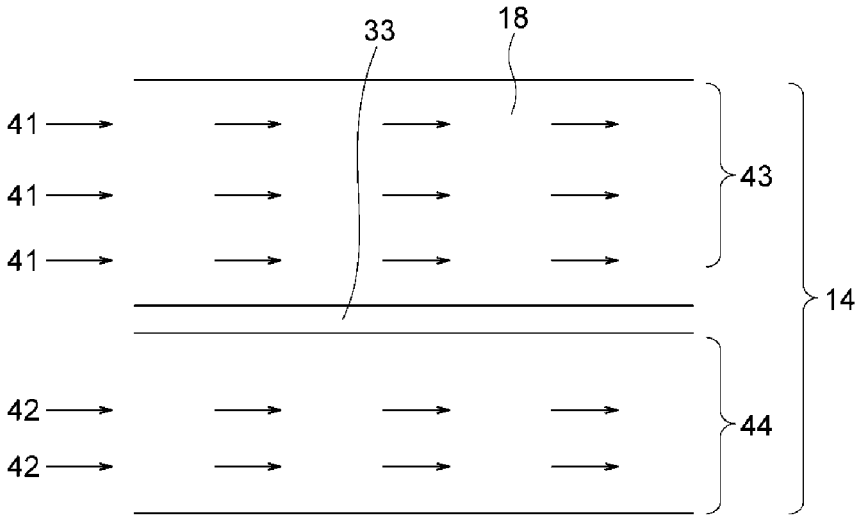
FIG. 21 is a view illustrating a groove-like coolant passage from a cylinder bore-side wall surface in a state in which a water jacket coolant passage division member (second embodiment) is disposed in the groove-like coolant passage.
Figure 22:
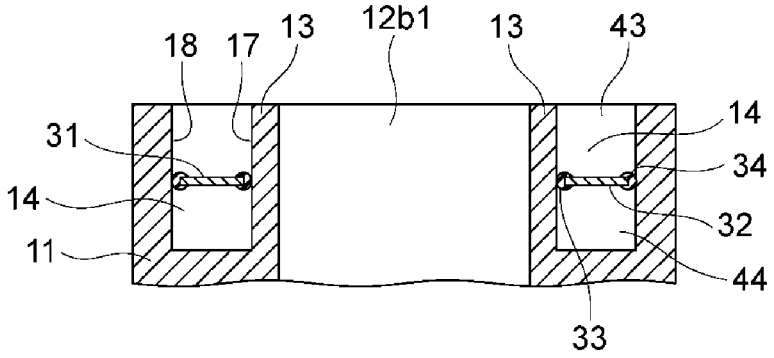
FIG. 22 is an end view illustrating a state in which a water jacket coolant passage division member (second embodiment) is disposed in a groove-like coolant passage.

The water jacket coolant passage division member according to one aspect of the invention may be designed so that the partition member is a metal plate member. A water jacket coolant passage division member according to a second embodiment of the invention is designed so that the partition member is a metal plate member. An example of the water jacket coolant passage division member according to the second embodiment of the invention, and an example of an internal combustion engine provided with the water jacket coolant passage division member according to the second embodiment of the invention, are described below with reference to FIGS. 1 to 3 and FIGS. 15 to 22. A cylinder block in which the water jacket coolant passage division member according to the second embodiment of the invention is disposed is the same as the cylinder block in which the water jacket coolant passage division member according to the first embodiment of the invention is disposed. The cylinder block may be the cylinder block illustrated in FIGS. 1 to 3. FIGS. 15 to 18 illustrate an example of the water jacket coolant passage division member according to the second embodiment of the invention. FIG. 15 is a schematic perspective view illustrating an example of the water jacket coolant passage division member according to the second embodiment of the invention, FIG. 16 is a top view illustrating the water jacket coolant passage division member illustrated in FIG. 15, and FIGS. 17 and 18 are end views taken along the line y-y illustrated in FIG. 15. FIG. 19 is a schematic view illustrating a state in which the water jacket coolant passage division member illustrated in FIG. 15 is disposed the cylinder block illustrated in FIG. 2, FIG. 20 is a schematic view illustrating a state in which the water jacket coolant passage division member illustrated in FIG. 15 is disposed in a groove-like coolant passage provided to the cylinder block illustrated in FIG. 2, FIG. 21 is a view illustrating the groove-like coolant passage from a cylinder bore-side wall surface in a state in which the water jacket coolant passage division member is disposed in the groove-like coolant passage, and FIG. 22 is an end view illustrating a state in which the water jacket coolant passage division member is disposed in the groove-like coolant passage.

A water jacket coolant passage division member 31 illustrated in FIGS. 15 to 18 includes a metal plate member 32, an inner-side rubber member 33, and an outer-side rubber member 34.

The metal plate member 32 is produced by forming a metal plate so as to have the desired shape. The metal plate member 32 functions as a partition plate that divides the groove-like coolant passage 14 into an upper part and a lower part along the circumferential direction.

The inner-side rubber member 33 is provided to an inner end 35 of the metal plate member. The inner-side rubber member 33 is provided to the inner end 35 of the metal plate member by fitting the inner end 35 of the metal plate member into a receiving section formed in the inner-side rubber member 33. Note that the inner end 35 of the metal plate member is situated on the side of the cylinder bore-side wall surface 17 of the groove-like coolant passage 14 when the water jacket coolant passage division member 31 has been disposed in the groove-like coolant passage 14. The inner end 35 of the metal plate member is situated on one end of the groove-like coolant passage 14 in the width direction when viewed from above.

The outer-side rubber member 34 is provided to an outer end 36 of the metal plate member. The outer-side rubber member 34 is provided to the outer end 36 of the metal plate member by fitting the outer end 36 of the metal plate member into a receiving section formed in the outer-side rubber member 34. Note that the outer end 36 of the metal plate member is situated on the side of the outer wall surface 18 of the groove-like coolant passage 14 when the water jacket coolant passage division member 31 has been disposed in the groove-like coolant passage 14. The outer end 36 of the metal plate member is situated on the other end of the groove-like coolant passage 14 in the width direction when viewed from above.

As illustrated in FIG. 19, the water jacket coolant passage division member 31 is inserted into the groove-like coolant passage 14 provided to the cylinder block 11, and disposed in the groove-like coolant passage 14 (see FIGS. 20 to 22). Note that FIG. 21 illustrates only the metal plate member, and the outer wall surface of the groove-like coolant passage.

When the water jacket coolant passage division member 31 is disposed in the groove-like coolant passage 14, the inner-side rubber member 33 comes in contact with the cylinder bore-side wall surface 17 of the groove-like coolant passage 14, and the outer-side rubber member 34 comes in contact with the outer wall surface 18 of the groove-like coolant passage 14.

When the inner-side rubber member 33 has come in contact with the cylinder bore-side wall surface 17 of the groove-like coolant passage 14, and the outer-side rubber member 34 has come in contact with the outer wall surface 18 of the groove-like coolant passage 14, so that the metal plate member 32 has been secured within the groove-like coolant passage 14, the groove-like coolant passage 14 is divided by the water jacket coolant passage division member 31 into an upper passage 43 and a lower passage 44. Therefore, when a pump that supplies a coolant 41 to the upper passage 43 of the groove-like coolant passage, and a pump that supplies a coolant 42 to the lower passage 44 of the groove-like coolant passage, are separately provided, it is possible to cause the flow rate of the coolant to differ between the upper passage 43 and the lower passage 44 of the groove-like coolant passage, and separately adjust the flow rate of the coolant that flows through the upper passage 43 of the groove-like coolant passage, and the flow rate of the coolant that flows through the lower passage 44 of the groove-like coolant passage.

The water jacket coolant passage division member according to the second embodiment of the invention includes a metal plate member that divides a groove-like coolant passage into an upper part and a lower part, the groove-like coolant passage being provided to a cylinder block that is provided to an internal combustion engine, an inner-side rubber member that is provided to the inner end of the metal plate member, and comes in contact with the cylinder bore-side wall surface of the groove-like coolant passage, and an outer-side rubber member that is provided to the outer end of the metal plate member, and comes in contact with the outer wall surface of the groove-like coolant passage.

The water jacket coolant passage division member according to the second embodiment of the invention may be designed so that the metal plate member has a shape that conforms to the entirety of the groove-like coolant passage, the inner-side rubber member is provided to the entirety or part of the inner end of the metal plate member along the longitudinal direction, and the outer-side rubber member is provided to the entirety or part of the outer end of the metal plate member along the longitudinal direction.

The water jacket coolant passage division member according to the second embodiment of the invention may be designed so that the metal plate member has a shape that conforms to part of the groove-like coolant passage, the inner-side rubber member is provided to the entirety or part of the inner end of the metal plate member along the longitudinal direction, and the outer-side rubber member is provided to the entirety or part of the outer end of the metal plate member along the longitudinal direction.

The metal plate member is a member that divides the groove-like coolant passage into an upper part and a lower part, and is produced by forming a metal plate so as to have the desired shape. The metal plate member functions as a partition plate that divides the groove-like coolant passage into an upper part and a lower part along the circumferential direction when the water jacket coolant passage division member has been disposed in the groove-like coolant passage. Therefore, the metal plate member has a shape that conforms to the shape of the groove-like coolant passage when viewed from above. Specifically, the metal plate member has a shape that can divide the groove-like coolant passage into an upper part and a lower part together with the inner-side rubber member and the outer-side rubber member at a position (position in the upward-downward direction) at which the metal plate member is disposed.

A material for producing the metal plate member is not particularly limited. It is preferable to use stainless steel (SUS), an aluminum alloy, or the like due to excellent long-life coolant resistance (hereinafter referred to as "LLC resistance") and high strength.

The thickness of the metal plate member is not particularly limited, but is preferably 0.1 to 2 mm, and particularly preferably 0.2 to 1.5 mm. If the thickness of the metal plate member is too small, the metal plate member may break due to the flow of the coolant. Therefore, the thickness of the metal plate member is preferably set to 0.1 mm or more, and particularly preferably 0.2 mm or more. If the thickness of the metal plate member is too large, it may be difficult to form such a metal plate member. Therefore, the thickness of the metal plate member is preferably set to 2 mm or less, and particularly preferably 1.5 mm or less. The width of the metal plate member is appropriately selected taking account of the width of the groove-like coolant passage. Note that the thickness of the metal plate member refers to the length indicated by reference numeral 37 in FIG. 18, and the width of the metal plate member refers to the length indicated by reference numeral 38 in FIG. 18.

Figure 23:
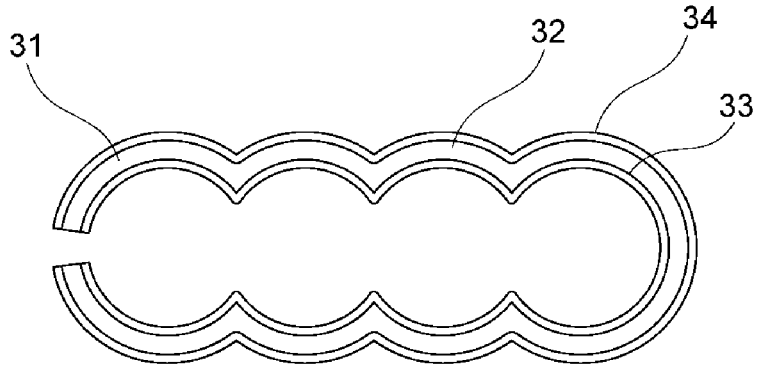
FIG. 23 is a plan view illustrating an example of a water jacket coolant passage division member (second embodiment).
Figure 24A:
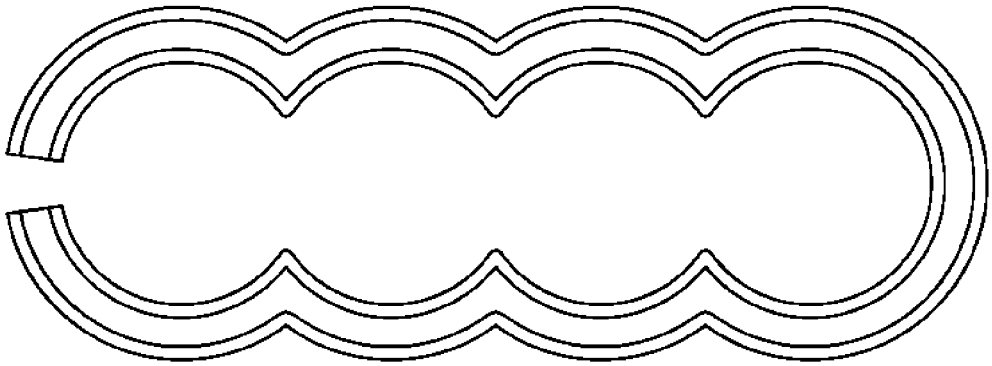
FIGS. 24A through 24C each is a schematic perspective view illustrating another example of a water jacket coolant passage division member (second embodiment).
Figure 24B:
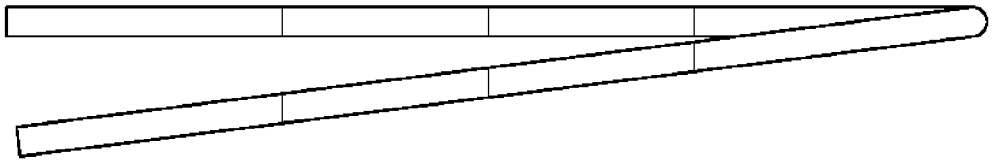
Figure 24C:
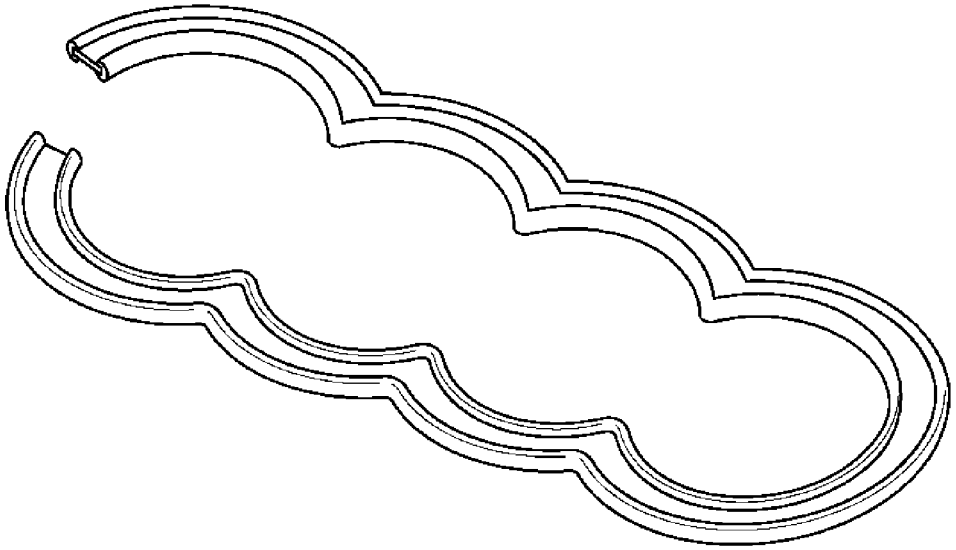
Figure 25:
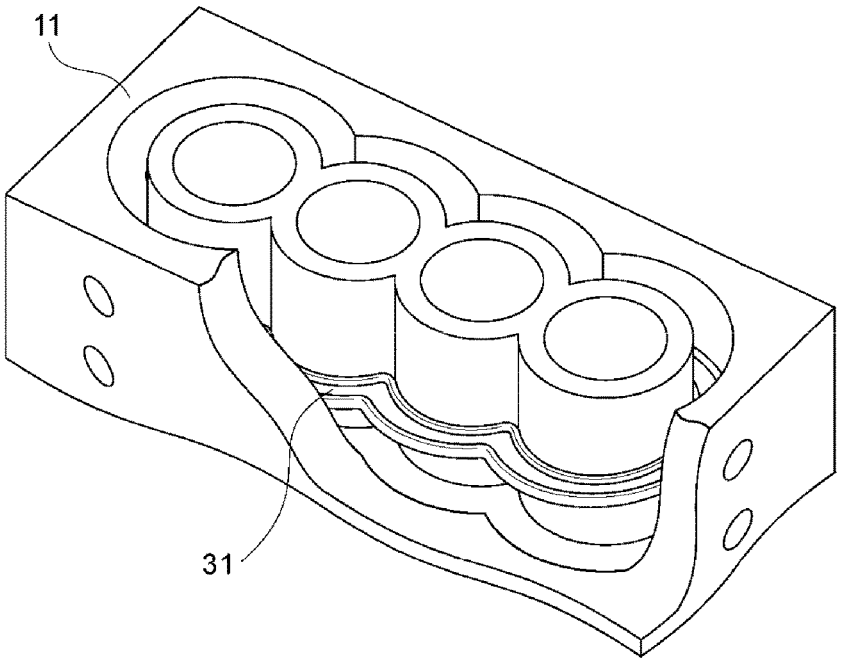
FIG. 25 is a schematic perspective view illustrating another example of a water jacket coolant passage division member (second embodiment).

In the example illustrated in FIG. 15, the metal plate member is continuously disposed in the groove-like coolant passage along the longitudinal direction. Note that the shape of the metal plate member is not particularly limited as long as it is possible to separately adjust the flow rate of the coolant that flows through the upper passage of the groove-like coolant passage, and the flow rate of the coolant that flows through the lower passage of the groove-like coolant passage. For example, the metal plate member may be broken along the longitudinal direction (see FIG. 23) as long as it is possible to substantially separately adjust the flow rate of the coolant that flows through the upper passage of the groove-like coolant passage, and the flow rate of the coolant that flows through the lower passage of the groove-like coolant passage. Specifically, the metal plate member may have a shape that conforms to the entirety of the groove-like coolant passage, or may have a shape that conforms to part of the groove-like coolant passage. Note that FIG. 23 is a schematic view illustrating an example of the metal plate member (i.e., a top view illustrating the metal plate member). Note that the longitudinal direction of the groove-like coolant passage and the longitudinal direction of the metal plate member refer to the circumferential direction along the cylinder bore wall.

In the example illustrated in FIG. 15, the metal plate member is formed so that the position of the metal plate member within the groove-like coolant passage in the upward-downward direction is almost constant along the circumferential direction of the groove-like coolant passage. Note that the metal plate member may be formed so that the position of the metal plate member within the groove-like coolant passage in the upward-downward direction differs depending on the position along the circumferential direction of the groove-like coolant passage (see FIGS. 24A to 24C and FIG. 25). Specifically, the metal plate member may be formed so that the position at which the groove-like coolant passage is divided by the metal plate member in the upward-downward direction is constant along the circumferential direction of the groove-like coolant passage, or may be formed so that the position at which the groove-like coolant passage is divided by the metal plate member in the upward-downward direction differs depending on the position along the circumferential direction of the groove-like coolant passage.

The inner-side rubber member and the outer-side rubber member are respectively provided to the inner end and the outer end of the metal plate member so that the inner-side rubber member and the outer-side rubber member come in contact with the wall surface of the groove-like coolant passage when the water jacket coolant passage division member has been disposed in the groove-like coolant passage such that the metal plate member is secured in the upward-downward direction.

When the water jacket coolant passage division member has been disposed in the groove-like coolant passage, the inner-side rubber member has come in contact with the cylinder bore-side wall surface of the groove-like coolant passage, and the outer-side rubber member has come in contact with the outer wall surface of the groove-like coolant passage (i.e., when the metal plate member has been fixed at a specific position), the groove-like coolant passage is divided into the upper passage and the lower passage.

In the example illustrated in FIG. 15, both the inner-side rubber member and the outer-side rubber member are continuously provided along the longitudinal direction of the metal plate member. Note that the configuration is not limited thereto. For example, the inner-side rubber member or the outer-side rubber member may be broken as long as it is possible to substantially separately adjust the flow rate of the coolant that flows through the upper passage of the groove-like coolant passage, and the flow rate of the coolant that flows through the lower passage of the groove-like coolant passage. Specifically, the inner-side rubber member may be provided to the entirety of the inner end of the metal plate member along the longitudinal direction, or may be provided to part of the inner end of the metal plate member along the longitudinal direction. The outer-side rubber member may be provided to the entirety of the outer end of the metal plate member along the longitudinal direction, or may be provided to part of the outer end of the metal plate member along the longitudinal direction.

A material for producing the inner-side rubber member and the outer-side rubber member is not particularly limited as long as the inner-side rubber member and the outer-side rubber member can come in contact with the cylinder bore-side wall surface or the outer wall surface of the groove-like coolant passage to substantially divide the groove-like coolant passage into the upper passage and the lower passage, and the material exhibits excellent LLC resistance, and exhibits a heat resistance sufficient to endure the temperature of the cylinder bore-side wall surface within the groove-like coolant passage. It is preferable that the inner-side rubber member and the outer-side rubber member be formed of a rubber material having a rubber hardness of 5 to 50, and particularly preferably 10 to 30. Examples of the material for producing the inner-side rubber member and the outer-side rubber member include a silicone rubber, a fluororubber, a natural rubber, a butadiene rubber, an ethylene-propylene-diene rubber (EPDM), a nitrile-butadiene rubber (NBR), and the like. It is preferable to use a heat-expandable rubber such as a silicone rubber, a fluororubber, a natural rubber, a butadiene rubber, an ethylene-propylene-diene rubber (EPDM), or a nitrile-butadiene rubber (NBR). The term "heat-expandable rubber" used herein refers to a composite obtained by impregnating a base foam material with a thermoplastic substance having a melting point lower than that of the base foam material, and compressing the resulting product. The heat-expandable rubber is characterized in that the compressed state is maintained at room temperature by the cured product of the thermoplastic substance that is present at least in the surface area, and the cured product of the thermoplastic substance softens due to heating so that the compressed state is canceled. When the inner-side rubber member and the outer-side rubber member are formed of the heat-expandable rubber, the heat-expandable rubber expands (is deformed) to have a specific shape when the water jacket spacer according to one embodiment of the invention has been disposed in the groove-like coolant passage, and heat has been applied to the heat-expandable rubber. Examples of the base foam material used to produce the heat-expandable rubber include a silicone rubber, a fluororubber, a natural rubber, a butadiene rubber, an ethylene-propylene-diene rubber (EPDM), and a nitrile-butadiene rubber (NBR). It is preferable to use a thermoplastic substance having a glass transition temperature, a melting point, or a softening temperature of less than 120° C. as the thermoplastic substance used to produce the heat-expandable rubber. Examples of the thermoplastic substance used to produce the heat-expandable rubber include a thermoplastic resin such as polyethylene, polypropylene, polystyrene, polyvinyl chloride, polyvinylidene chloride, polyvinyl acetate, a polyacrylate, a styrene-butadiene copolymer, chlorinated polyethylene, polyvinylidene fluoride, an ethylene-vinyl acetate copolymer, an ethylene-vinyl acetate-vinyl chloride-acrylate copolymer, an ethylene-vinyl acetate-acrylate copolymer, an ethylene-vinyl acetate-vinyl chloride copolymer, nylon, an acrylonitrile-butadiene copolymer, polyacrylonitrile, polyvinyl chloride, polychloroprene, polybutadiene, a thermoplastic polyimide, a polyacetal, polyphenylene sulfide, a polycarbonate, and a thermoplastic polyurethane, and a thermoplastic compound such as a low-melting-point glass frit, starch, a solder, and a wax.

The length (i.e., the length indicated by reference numeral 39 in FIG. 17) from the contact part of the inner-side rubber member to the contact part of the outer-side rubber member is appropriately selected corresponding to the groove-like coolant passage.

In the example illustrated in FIG. 15, the inner-side rubber member and the outer-side rubber member are provided to the inner end and the outer end of the metal plate member in a state in which the inner end and the outer end of the metal plate member are fitted into the receiving sections formed in the inner-side rubber member and the outer-side rubber member. Note that the configuration is not limited thereto. An arbitrary method may be used as long as the inner-side rubber member and the outer-side rubber member can be provided to the metal plate member. For example, the inner-side rubber member and the outer-side rubber member may be provided to the inner end and the outer end of the metal plate member by means of injection molding.

When the water jacket coolant passage division member according to one aspect of the invention has been disposed in the groove-like coolant passage, the inner-side rubber member has come in contact with the cylinder bore-side wall surface of the groove-like coolant passage, and the outer-side rubber member has come in contact with the outer wall surface of the groove-like coolant passage, so that the partition member has been disposed at a specific position within the groove-like coolant passage, the groove-like coolant passage is divided by the partition member into the upper passage and the lower passage, and it is possible to separately adjust the flow rate of the coolant that flows through the upper passage of the groove-like coolant passage, and the flow rate of the coolant that flows through the lower passage of the groove-like coolant passage, so that the desired flow rate is achieved. This makes it possible to separately adjust the flow rate of the coolant that flows through the upper passage of the groove-like coolant passage, and the flow rate of the coolant that flows through the lower passage of the groove-like coolant passage, corresponding to the difference in temperature between the upper part and the lower part of the cylinder bore wall, or a change in wall temperature, so that the upper part and the lower part of the cylinder bore wall have a uniform temperature. Therefore, the water jacket coolant passage division member according to one aspect of the invention ensures that the cylinder bore wall has a uniform temperature.

An internal combustion engine according to another aspect of the invention includes the water jacket coolant passage division member according to one aspect of the invention that is disposed in a groove-like coolant passage provided to a cylinder block. An automobile according to a further aspect of the invention includes the internal combustion engine according to one aspect of the invention.

INDUSTRIAL APPLICABILITY

According to the embodiments of the invention, since the difference in the amount of deformation between the upper part and the lower part of the cylinder bore wall of an internal combustion engine can be reduced (i.e., friction with respect to a piston can be reduced), it is possible to provide a fuel-efficient internal combustion engine.

REFERENCE SIGNS LIST

1: Water jacket coolant passage division member (first embodiment)
2: Resin partition member
3, 33: Inner-side rubber member
4, 34: Outer-side rubber member
5: Inner side surface of resin partition member
6: Outer side surface of resin partition member
11: Cylinder block
12: Bore
13: Cylinder bore wall
14: Groove-like coolant passage
15*a*, 15*b*: Coolant inlet
16*a*, 16*b*: Coolant outlet
17: Cylinder bore-side wall surface of groove-like coolant passage
18: Outer wall surface of groove-like coolant passage
23, 43: Upper passage of groove-like coolant passage
24, 44: Lower passage of groove-like coolant passage
31: Water jacket coolant passage division member (second embodiment)
32: Metal plate member
35: Inner end of metal plate member
36: Outer end of metal plate member

The invention claimed is:

1. A water jacket coolant passage division member comprising: a partition member that divides a groove-like coolant passage into an upper part and a lower part, the groove-like coolant passage being provided to a cylinder block that is provided to an internal combustion engine; an inner-side rubber member that is provided to an inner side of the partition member, and comes in contact with a cylinder bore-side wall surface of the groove-like coolant passage; and an outer-side rubber member that is provided to an outer side of the partition member, and comes in contact with an outer wall surface of the groove-like coolant passage, wherein the water jacket coolant passage division member is free of any member extending into said lower part of the groove-like coolant passage below the partition member that divides said lower part of the groove-like coolant passage below the partition member into inner and outer sides; wherein the water jacket coolant passage division member has a plate-shape bottom surface extending across the entire width of said water jacket coolant passage division member between the inner-side rubber member and the outer-side rubber member that creates an upper flow boundary that guides coolant flow within said lower part of the groove-like coolant passage below the partition member without dividing said lower part of the groove-like coolant passage below the partition member.

2. The water jacket coolant passage division member according to claim 1, wherein the partition member has a shape that conforms to the entirety of the groove-like coolant passage, the inner-side rubber member is provided to the entirety or part of the inner side of the partition member along a longitudinal direction, and the outer-side rubber member is provided to the entirety or part of the outer side of the partition member along the longitudinal direction.

3. The water jacket coolant passage division member according to claim 1, wherein the partition member has a shape that conforms to part of the groove-like coolant passage, the inner-side rubber member is provided to the entirety or part of the inner side of the partition member along a longitudinal direction, and the outer-side rubber member is provided to the entirety or part of the outer side of the partition member along the longitudinal direction.

4. The water jacket coolant passage division member according to claim 1, wherein the partition member is a resin partition member, the inner-side rubber member is provided to an inner side surface of the resin partition member, and the outer-side rubber member is provided to an outer side surface of the resin partition member.

5. The water jacket coolant passage division member according to claim 1, wherein the partition member is a metal plate member, the inner-side rubber member is provided to an inner end of the metal plate member, and the outer-side rubber member is provided to an outer end of the metal plate member.

6. The water jacket coolant passage division member according to claim 1, wherein the inner-side rubber member and the outer-side rubber member are formed of a silicone rubber, a fluororubber, an ethylene-propylene-diene rubber (EPDM), or a nitrile-butadiene rubber (NBR).

7. The water jacket coolant passage division member according to claim 6, wherein the inner-side rubber member and the outer-side rubber member are formed of a heat-expandable rubber that comprises a silicone rubber, a fluororubber, an ethylene-propylene-diene rubber (EPDM), or a nitrile-butadiene rubber (NBR).

8. An internal combustion engine comprising the water jacket coolant passage division member according to claim 1, the water jacket coolant passage division member being disposed in a groove-like coolant passage provided to a cylinder block.

9. An automobile comprising the internal combustion engine according to claim 8.

10. The water jacket coolant passage division member according to claim 1, wherein said partition member has a maximum thickness of 30 mm or less.

11. The water jacket coolant passage division member according to claim 10, wherein said partition member has a maximum thickness of 20 mm or less.

12. The water jacket coolant passage division member according to claim 10, wherein said partition member has a maximum thickness of between 2 mm and 20 mm.

13. The water jacket coolant passage division member according to claim 1, wherein said plate-shape bottom surface extending across the entire width of said water jacket coolant passage division member between the inner-side rubber member and the outer-side rubber member is a flat horizontal surface extending across the entire width of said water jacket coolant passage division member.

* * * * *